US010697596B2

(12) United States Patent
Mullen

(10) Patent No.: US 10,697,596 B2
(45) Date of Patent: Jun. 30, 2020

(54) SIMULATED ROCK WITH PRE-INSTALLED LIGHTING CANS

(71) Applicant: Nate Mullen, Valley Center, CA (US)

(72) Inventor: Nate Mullen, Valley Center, CA (US)

( * ) Notice: Subject to any disclaimer, the term of this patent is extended or adjusted under 35 U.S.C. 154(b) by 0 days.

(21) Appl. No.: 16/502,888

(22) Filed: Jul. 3, 2019

(65) Prior Publication Data

US 2020/0011492 A1 Jan. 9, 2020

Related U.S. Application Data

(60) Provisional application No. 62/694,234, filed on Jul. 5, 2018.

(51) Int. Cl.
*F21S 2/00* (2016.01)
*F21W 131/10* (2006.01)

(52) U.S. Cl.
CPC ..... *F21S 2/00* (2013.01); *F21W 2131/10* (2013.01)

(58) Field of Classification Search
CPC ..... F21S 2/00; F21W 2131/10
See application file for complete search history.

(56) References Cited

U.S. PATENT DOCUMENTS 5,803,594 A * 9/1998 Fredrickson ..... F21S 8/032 362/351
6,168,290 B1 * 1/2001 Christiansen ..... F21V 7/0008 362/253
6,409,359 B1 * 6/2002 O'Connell ..... G09F 13/04 362/145
7,175,793 B1 * 2/2007 Reed ..... B28B 7/346 264/220
9,526,152 B1 * 12/2016 Toomey ..... H05B 37/0272
2014/0099457 A1 * 4/2014 Wang ..... B29C 45/14311 428/35.8

* cited by examiner

*Primary Examiner* — Joseph L Williams
*Assistant Examiner* — Jose M Diaz
(74) *Attorney, Agent, or Firm* — Kelly & Kelley, LLP

(57) ABSTRACT

A simulated landscape rock having a hollow shell with an exterior surface that resembles a rock. One or more lighting cans are installed on an interior surface of the hollow shell. Where the simulated landscape rock is set-up by selectively drilling a hole through the exterior surface of the hollow shell in-line with one or more of the lighting cans. Each lighting can is configured to removably receive a light fixture with illumination from the light fixture directed through the hole drilled in the exterior surface.

7 Claims, 8 Drawing Sheets

SIMULATED ROCK WITH PRE-INSTALLED LIGHTING CANS

BACKGROUND OF THE INVENTION

The present invention is directed to a simulated rock for use in landscape lighting installations. More particularly, the inventive simulated rock has a plurality of pre-installed lighting cans to allow for the hidden installation of landscape lighting.

Simulated rocks have been used in landscape lighting for decoration. Lights are often installed around or behind such simulated rocks to mask their presence. In such instances, the lights may be visible from certain views depending upon the person's position around the perimeter of the landscape lighting area.

Sometimes, the simulated rocks are hollow and may have a hole therein to allow the passage of illumination from a light installed under the simulated rock. In such instances, the light must be installed in the ground (as by a ground stake) and the simulated rock positioned over the light. With such an installation, the direction of the illumination from the light must very closely match the hole in the simulated rock or a portion of the illumination will be blocked by the simulated rock. In addition, such installations are subject to movement and settling over time such that the light and hole may become out of alignment.

Accordingly, there is a need for a simulated rock for landscape lighting that more readily lends itself to the covering of light fixtures and more reliably allows for the passage of light through openings in the simulated rock. The present invention fulfills these needs and provides other related advantages.

SUMMARY OF THE INVENTION

The present invention is directed to a simulated landscape rock for installing light fixtures. The simulated landscape rock generally includes a shell having an exterior surface configured so as to resemble a natural rock surface and a generally hollow interior defining a bottom edge and an interior surface. A lighting can being a generally hollow cylinder having a first end and a second end is disposed in the hollow interior. The hollow cylinder is configured to receive a light fixture. The first end of the hollow cylinder is attached to the interior surface of the shell.

The lighting can preferably comprises a plurality of lighting cans, each of which are oriented at different angles with respect to the exterior surface. The shell is preferably made from a durable material such as polyurea or polyurethane. The simulated landscape rock further includes a connection plug installed in the lighting can and electrically connected to an electrical source, wherein the connection plug is configured for electrical connection to the light fixture received in the lighting can.

The electrical source is preferably a transformer installed in the hollow interior of the shell. The hollow interior is preferably filled with an electrical potting material that encases the transformer.

The present invention is also directed to a method for using the simulated landscape rock of the type described herein. The method begins with providing a simulate landscape rock as described. A hole is then cut through the exterior surface of the shell, wherein the hole is in-line with the lighting can. A light fixture is installed in the lighting can proximate to the hole drilled through the exterior surface. The light fixture is connected to an electrical source, such as a transformer, by wires passed into the lighting can. The bottom edge of the shell is placed on a ground surface and the light fixture is positioned to illuminate a landscape feature.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
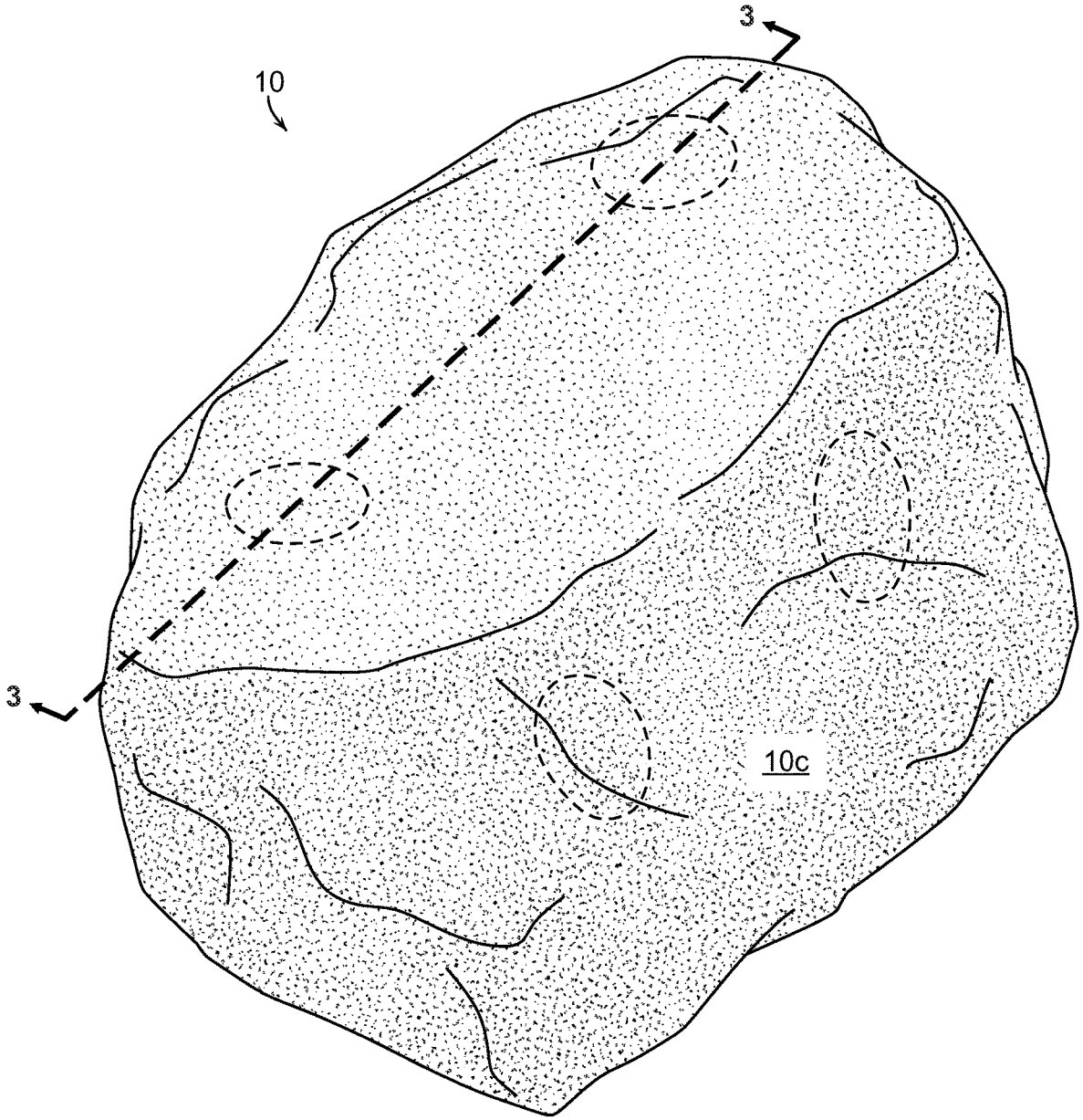
FIG. 1 is an elevated perspective view of a simulated rock according to the present invention.
Figure 2:
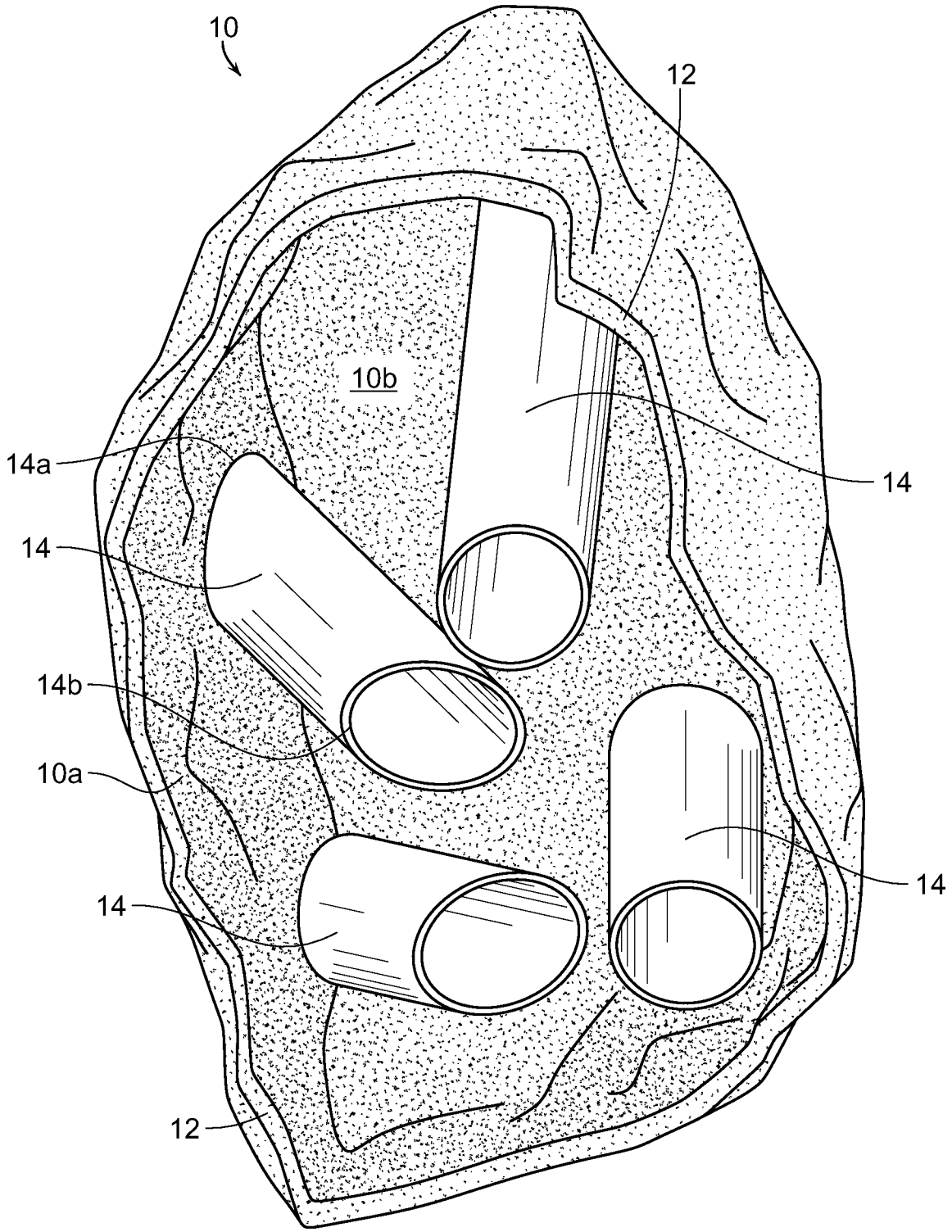
FIG. 2 is lowered perspective view of simulated rock according to the present invention.
Figure 3:
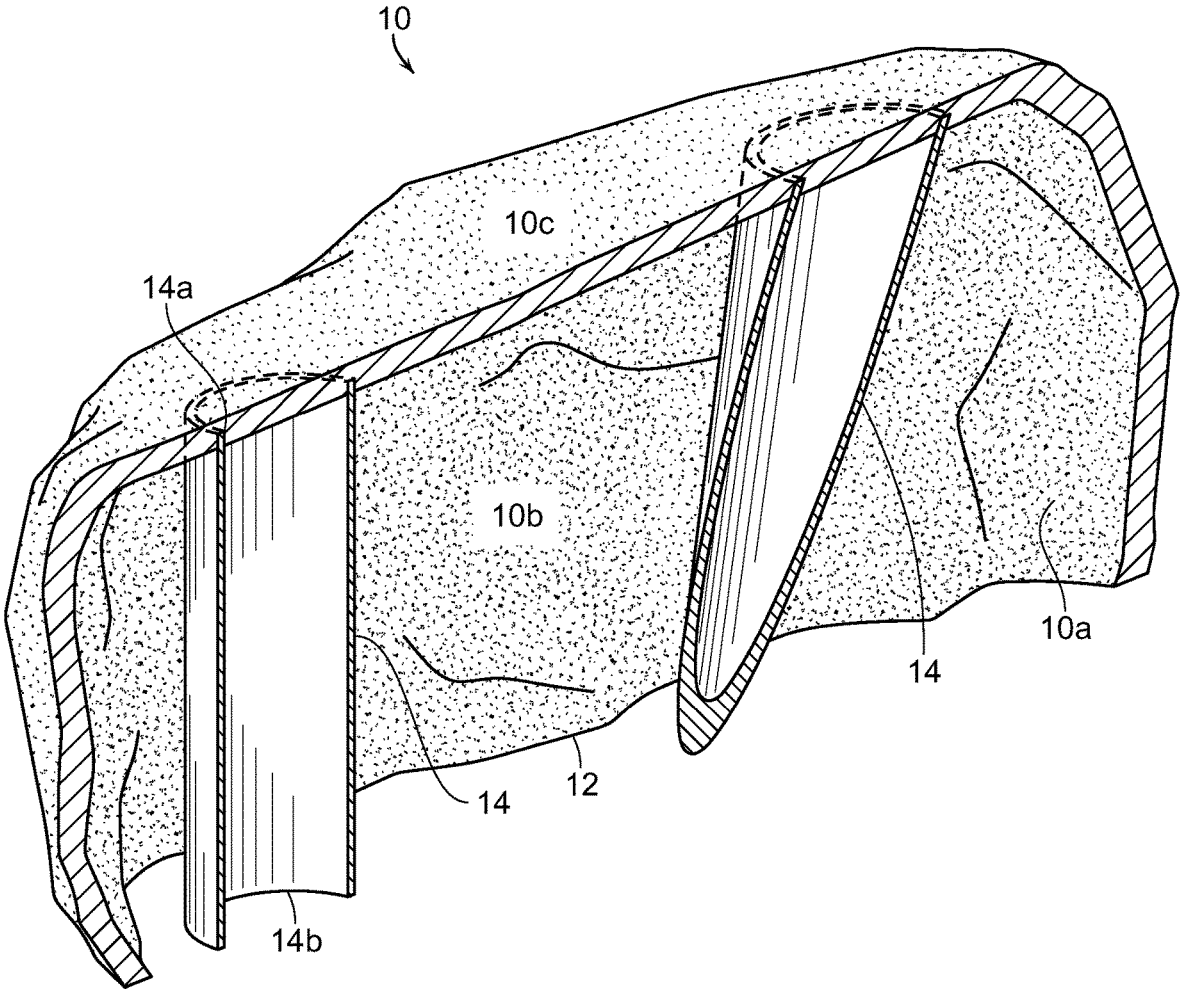
FIG. 3 is a cross-sectional view taken along line 3-3 of FIG. 1.

The present invention is directed to simulated rock for use in landscape lighting installations. In the following detailed description, the inventive simulated rock will be generally referred to by reference numeral 10. FIGS. 1-7 generally show the simulated rock 10 from multiple angles and in installations. The simulated rock 10 is intended for use in landscape settings so as to allow for the hidden installation of lighting fixtures, such that the lighting fixture itself will not detract from or obstruct the décor of the landscape. The simulated rock 10 is effectively a hollow shell made from a durable material such as polyuria or polyurethane.

Figure 4:
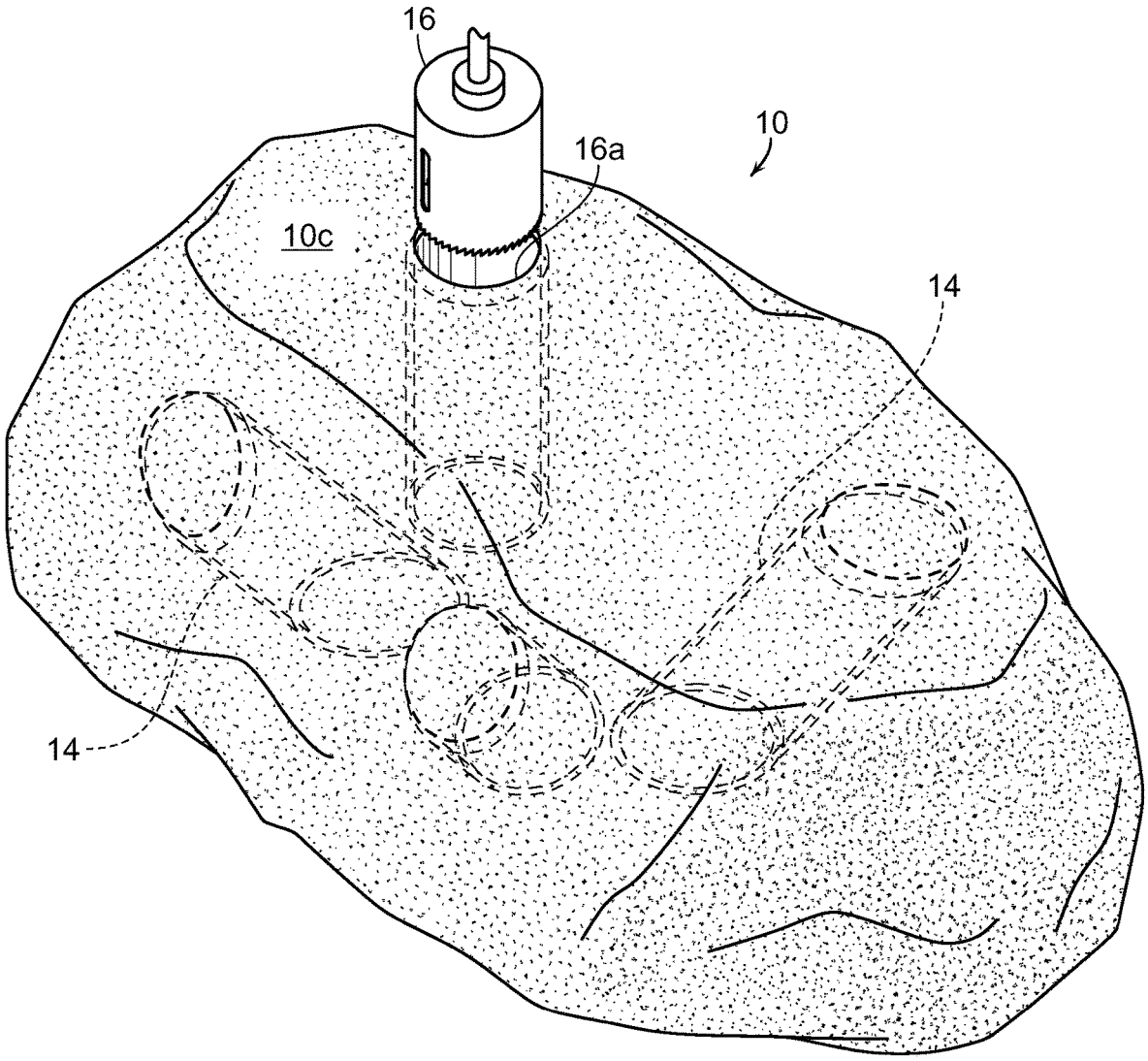
FIG. 4 is an elevated perspective view illustrating the drilling of a hole in a simulated rock over a pre-installed lighting can according to the present invention.

The simulated rock 10 has a hollow interior 10*a* and has an open bottom surrounded by a bottom edge 12 such that it can rest on the ground or other generally flat surface. The rock 10 includes at least one pre-installed lighting can 14, but preferably includes a plurality of pre-installed lighting cans 14 within the hollow interior 10*a*. Such lighting cans 14 are common in the landscape lighting industry and consist of a length of ABS or PVC (or similar) pipe. The broken lines in FIGS. 1 and 4 show the lighting cans 14 on the interior of the simulated rock 10. The pre-installed lighting cans 14 may be provided in varied sizes from large three-inch pipes to accommodate large rubberized light fixtures to smaller diameter pipes configured to accommodate MR-16 or similar lights.

The lighting cans 14 have a first end 14*a* and a second end 14*b*. The first end 14*a* of the hollow cans 14 are attached to an interior wall 10*b* of the simulated rock 10 as by cement or similar bonding material. Each of the plurality of lighting cans 14 extend away from the interior wall 10*b*, preferably at different angles. The second end 14*b* of the lighting cans 14 is unattached to any surface and extends into the hollow interior 10*a*, preferably ending or terminating at a point within the hollow interior 10*a* so as not to protrude beyond the bottom edge 12 of the simulated rock 10.

Figure 5:
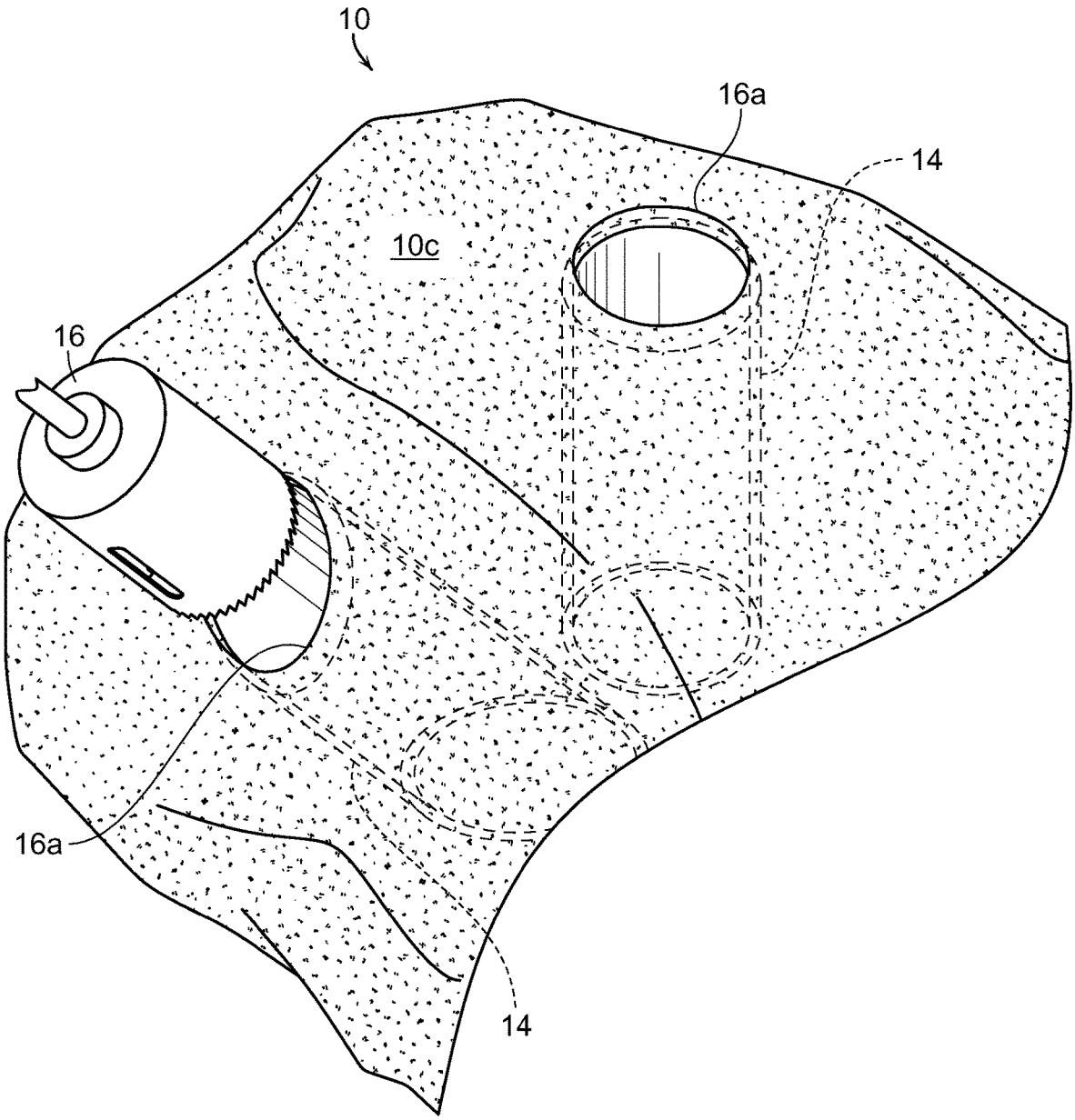
FIG. 5 is a close-up view illustrating the drilling of a second hole in a simulated rock over a second pre-installed lighting can according to the present invention.

As shown in FIGS. 4 and 5, the exterior surface 10*c* of the simulated rock 10 may be selectively drilled through with a hole saw 16 or similar tool, to create a hole 16*a* in-line with the pre-installed lighting cans 14. In this way, one or more of the pre-installed lighting cans 14 can be opened up for use.

Figure 6:
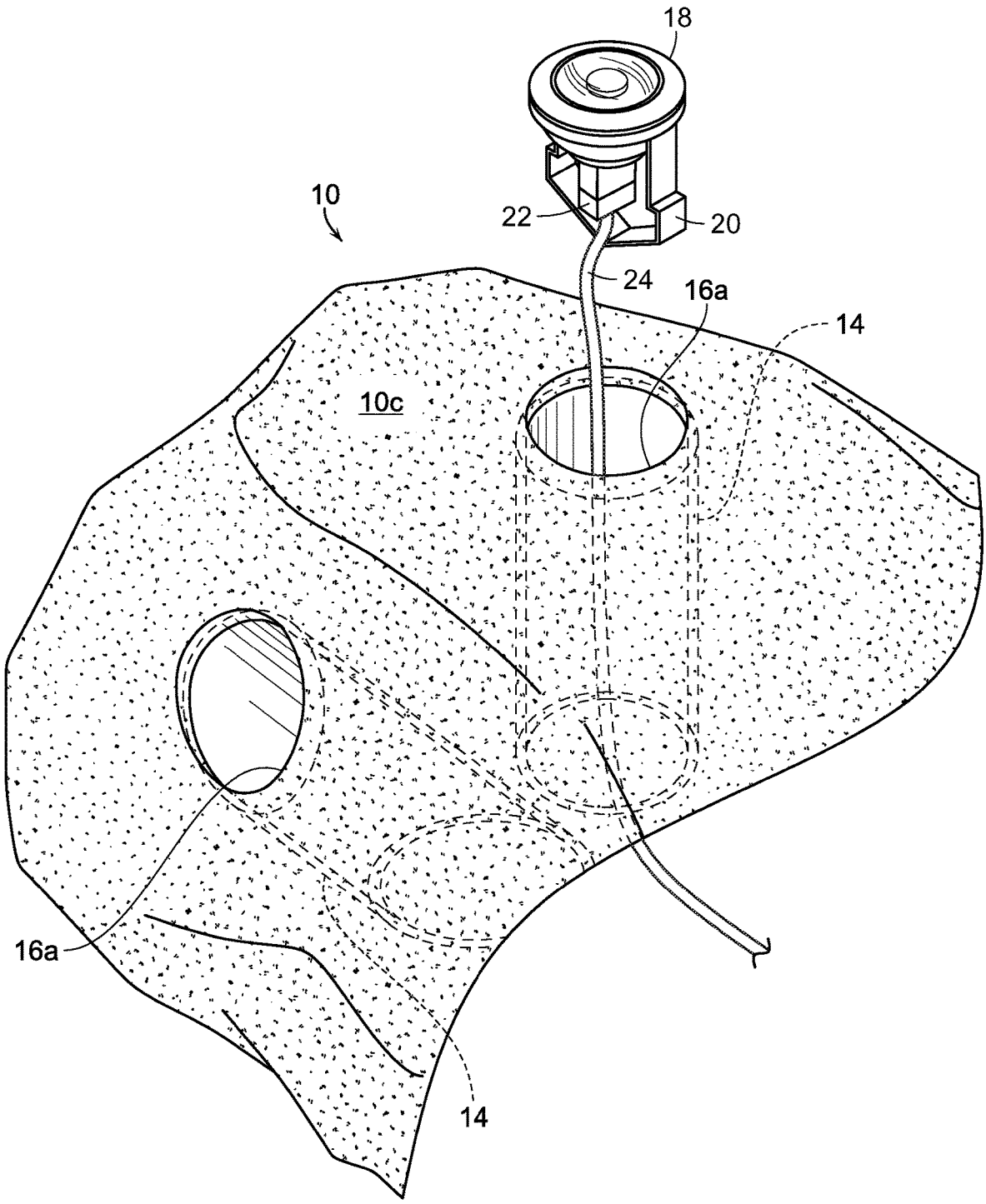
FIG. 6 is a close-up view illustrating the installation of a light fixture into one of the opened lighting cans on the simulated rock according to the present invention.

FIG. 6 shows a light fixture 18 being inserted into one of the opened lighting cans 14. The light fixture 18 has a spring or tension biased ring 20 for holding the light fixture 18 in place against an interior wall of the lighting can 14 when installed. A connection plug 22 is positioned inside of the lighting can 14 for connection to the light fixture 18, and has electrical wires 24 extending from the second end 14*b* and to an electrical source (not shown).

Figure 7:
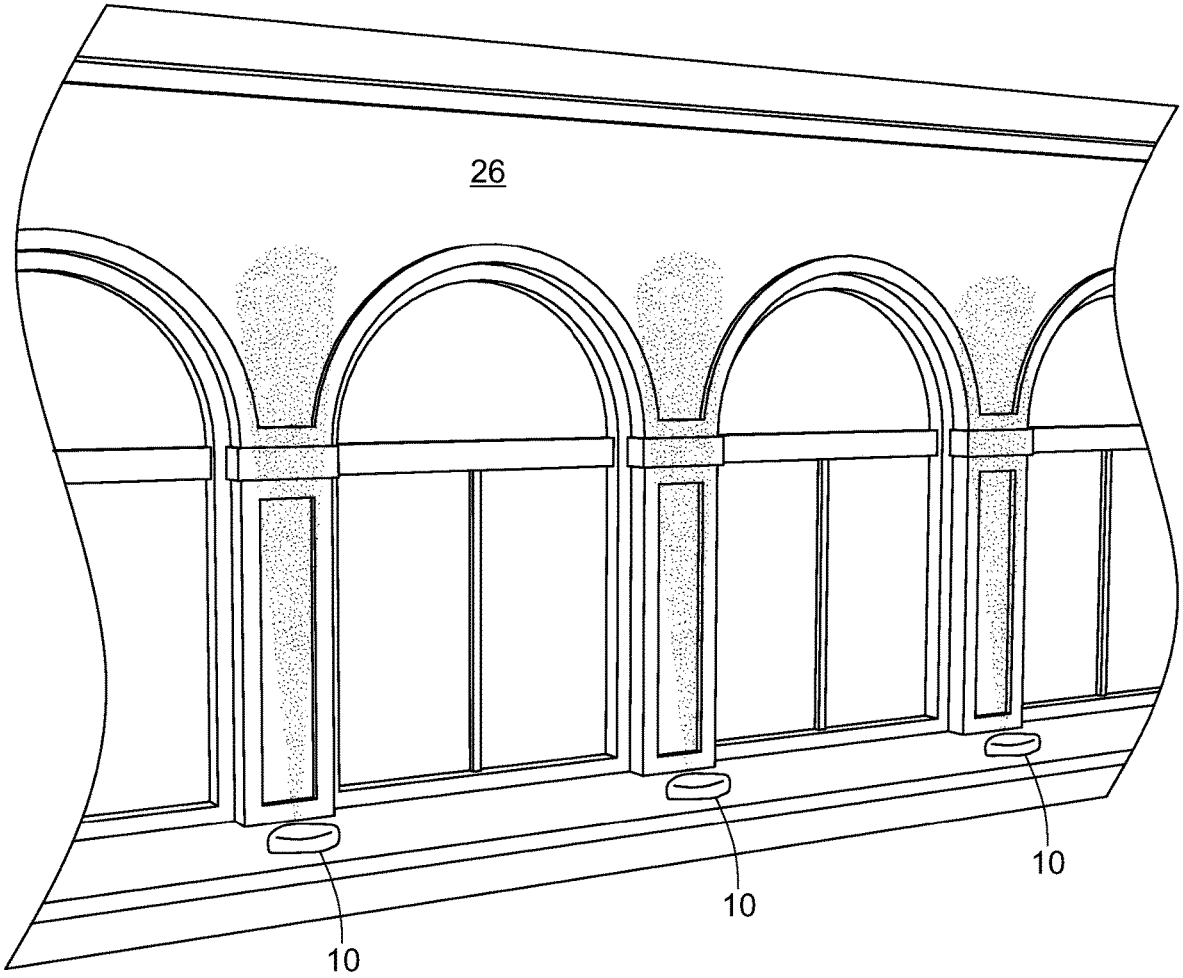
FIG. 7 is an environmental view illustrating multiple, installed simulated rocks according to the present invention.

FIG. 7 shows an environmental view of multiple simulated rocks 10 installed adjacent to a building 26 to illuminate the side of the building without having visible light fixtures. The simulated rocks 10 blend in with the environment and conceal the presence of the light fixtures.

Figure 8:
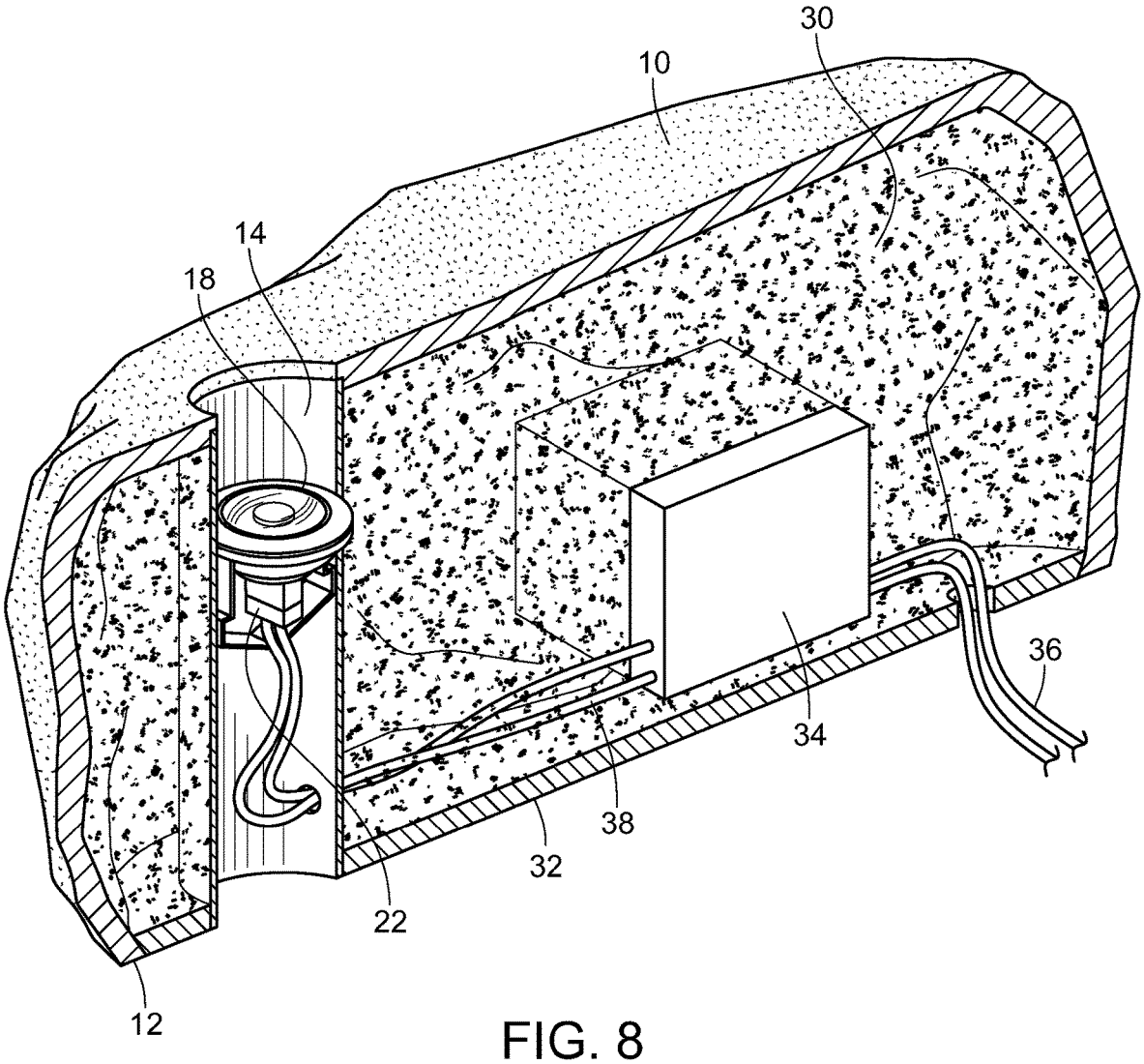
FIG. 8 is a cross-sectional view of an alternate embodiment of simulated rock according to the present invention.

FIG. 8 illustrates an alternate embodiment of the simulated rock 10, wherein the hollow interior 10*b* is filled with electrical potting material 30. Electrical potting is a process of filling a complete electronic assembly with a solid or gelatinous compound for resistance to shock and vibration, and for exclusion of moisture and corrosive agents, often consisting of thermosetting plastics, silicone rubber, or epoxy resins. The electrical potting materials 30 is sealed in the hollow interior 10*b* of the simulated rock 10 by a sealing barrier 32 the spans the bottom edge 12, with an opening for the pre-installed can 14. The electrical potting material 30 is designed to protect the simulated rock 10 and any installed electrical components from intrusion by water or other corrosives, as well as, to protect from shock and impact.

The electrical potting material 30 surrounds at least one pre-installed lighting can 14 and an embedded transformer 34. The transformer 34 includes a homerun wire 36 that passes through the sealing barrier 32 and is configured for connection to an external power source (not shown). Electrical wires 38 extend from the transformer 34, into the pre-installed can 14 (as through a port or other passage), and connect to a connection plug 22 configured for connection to a light fixture 18.

Although several embodiments have been described in detail for purposes of illustration, various modifications may be made without departing from the scope and spirit of the invention.

What is claimed is:

1. A simulated landscape rock, comprising:

a shell having an exterior surface configured so as to resemble a natural rock surface and a generally hollow interior defining a bottom edge and an interior surface;

a plurality of lighting cans, each comprising a generally hollow cylinder having a first end and a second end, wherein the hollow cylinder is configured to receive a light fixture, and wherein the first end is attached to the interior surface of the shell, each of the plurality of lighting cans oriented at different angles with respect to the exterior surface.

2. The simulated landscape rock of claim 1, wherein the shell is made from polyurea or polyurethane.

3. The simulated landscape rock of claim 1, further comprising a connection plug installed in the lighting can and electrically connected to an electrical source, wherein the connection plug is configured for electrical connection to the light fixture received in the lighting can.

4. A simulated landscape rock, comprising:

a shell having an exterior surface configured so as to resemble a natural rock surface and a generally hollow interior defining a bottom edge and an interior surface;

a lighting can comprising a generally hollow cylinder having a first end and a second end, wherein the hollow cylinder is configured to receive a light fixture, and wherein the first end is attached to the interior surface of the shell; and a connection plug installed in the lighting can and electrically connected to an electrical source, wherein the connection plug is configured for electrical connection to the light fixture received in the lighting can, wherein the electrical source comprises a transformer installed in the hollow interior of the shell.

5. The simulated landscape rock of claim 4, wherein the hollow interior is filled with an electrical potting material that encases the transformer.

6. A method for using the simulated landscape rock of claim 1, comprising the steps of:

cutting a hole through the exterior surface of the shell, wherein the hole is in-line with the lighting can;

installing a light fixture in the lighting can proximate to the hole drilled through the exterior surface;

connecting the light fixture to an electrical source by wires passed into the lighting can; and placing the bottom edge of the shell on a ground surface.

7. The simulated landscape rock of claim 3, wherein the electrical source comprises a transformer installed in the hollow interior of the shell, and wherein the hollow interior is filled with an electrical potting material that encases the transformer and the lighting can.

* * * * *